US010081511B2

(12) United States Patent
Salmikuukka

(10) Patent No.: US 10,081,511 B2
(45) Date of Patent: Sep. 25, 2018

(54) METHOD AND A SYSTEM FOR AUTOMATIC GENERATION OF ELEVATOR CALLS

(71) Applicant: KONE Corporation, Helsinki (FI)

(72) Inventor: Jukka Salmikuukka, Espoo (FI)

(73) Assignee: KONE CORPORATION, Helsinki (FI)

( * ) Notice: Subject to any disclaimer, the term of this patent is extended or adjusted under 35 U.S.C. 154(b) by 468 days.

(21) Appl. No.: 14/716,682

(22) Filed: May 19, 2015

(65) Prior Publication Data

US 2015/0251874 A1 Sep. 10, 2015

Related U.S. Application Data

(63) Continuation of application No. PCT/FI2013/051154, filed on Dec. 11, 2013.

(30) Foreign Application Priority Data

Dec. 18, 2012 (FI) ..... 20126321

(51) Int. Cl.
*B66B 1/20* (2006.01)
*B66B 1/24* (2006.01)
*B66B 1/46* (2006.01)

(52) U.S. Cl.
CPC ..... *B66B 1/2408* (2013.01); *B66B 1/468* (2013.01); *B66B 2201/232* (2013.01); *B66B 2201/4615* (2013.01); *B66B 2201/4623* (2013.01); *B66B 2201/4653* (2013.01)

(58) Field of Classification Search
CPC ..... B66B 1/2408; B66B 1/468; B66B 2201/4615; B66B 2201/4623; B66B 2201/4653; B66B 2201/232
USPC ..... 187/247, 380–388, 391, 392, 393, 396
See application file for complete search history.

(56) References Cited

U.S. PATENT DOCUMENTS 4,520,905 A * 6/1985 Sasao ..... B66B 1/18 187/380
4,685,538 A * 8/1987 Kamaike ..... B66B 1/468 187/380
4,852,695 A * 8/1989 Ostrowiecki ..... B66B 1/20 187/380
6,397,976 B1 6/2002 Hale et al.
8,348,018 B2 * 1/2013 Kostka ..... B66B 3/02 187/249

(Continued)

FOREIGN PATENT DOCUMENTS

FI 121880 B 5/2011
JP 4-251080 A 9/1992

(Continued)

*Primary Examiner* — Anthony Salata
(74) *Attorney, Agent, or Firm* — Birch, Stewart, Kolasch & Birch, LLP

(57) ABSTRACT

A method and system are provided for generating automatic elevator calls for an elevator system in a building, in which is a plurality of apartments and in the apartments an apartment-specific sensor, the sensor signal produced by which detects that a person is leaving or has left an apartment. On the basis of the sensor signal, an elevator is called to the floor on which the apartment is situated for collecting the person who has left the apartment.

5 Claims, 1 Drawing Sheet

(56) References Cited

U.S. PATENT DOCUMENTS

| | | | | |
|---|---|---|---|---|
| 8,528,701 | B2 * | 9/2013 | Schwarzentruber | B66B 1/468 187/384 |
| 8,544,612 | B2 * | 10/2013 | Korhonen | B66B 1/468 187/387 |
| 8,556,042 | B2 * | 10/2013 | Gerstenkorn | B66B 1/468 187/388 |
| 8,813,917 | B2 * | 8/2014 | Salmikuukka | B66B 1/468 187/247 |
| 9,327,940 | B2 * | 5/2016 | Hanninen | B66B 1/2491 |
| 9,382,096 | B2 * | 7/2016 | Finschi | B66B 1/468 |
| 9,469,500 | B2 * | 10/2016 | Friedli | B66B 1/2408 |
| 2011/0048862 | A1 | 3/2011 | Schwarzentruber | |
| 2013/0228399 | A1 | 9/2013 | Eto et al. | |
| 2015/0114763 | A1 * | 4/2015 | Kim | B66B 5/0012 187/392 |

FOREIGN PATENT DOCUMENTS

| | | | |
|---|---|---|---|
| JP | 6-72644 | A | 3/1994 |
| JP | 6-234468 | A | 8/1994 |
| JP | 2003-112860 | A | 4/2003 |
| WO | WO 2006/000618 | A2 | 1/2006 |
| WO | WO 2012/022827 | A1 | 2/2012 |
| WO | WO 2012/101770 | A1 | 8/2012 |

* cited by examiner

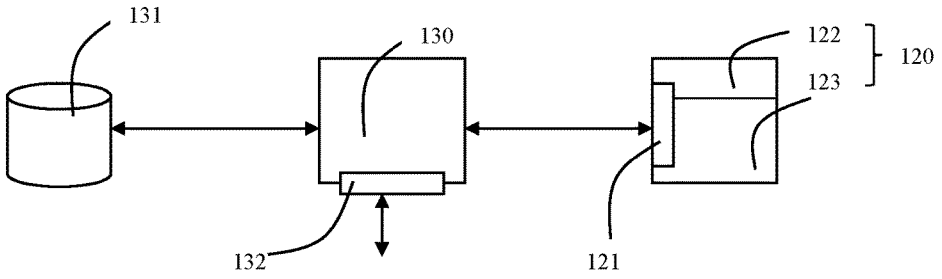
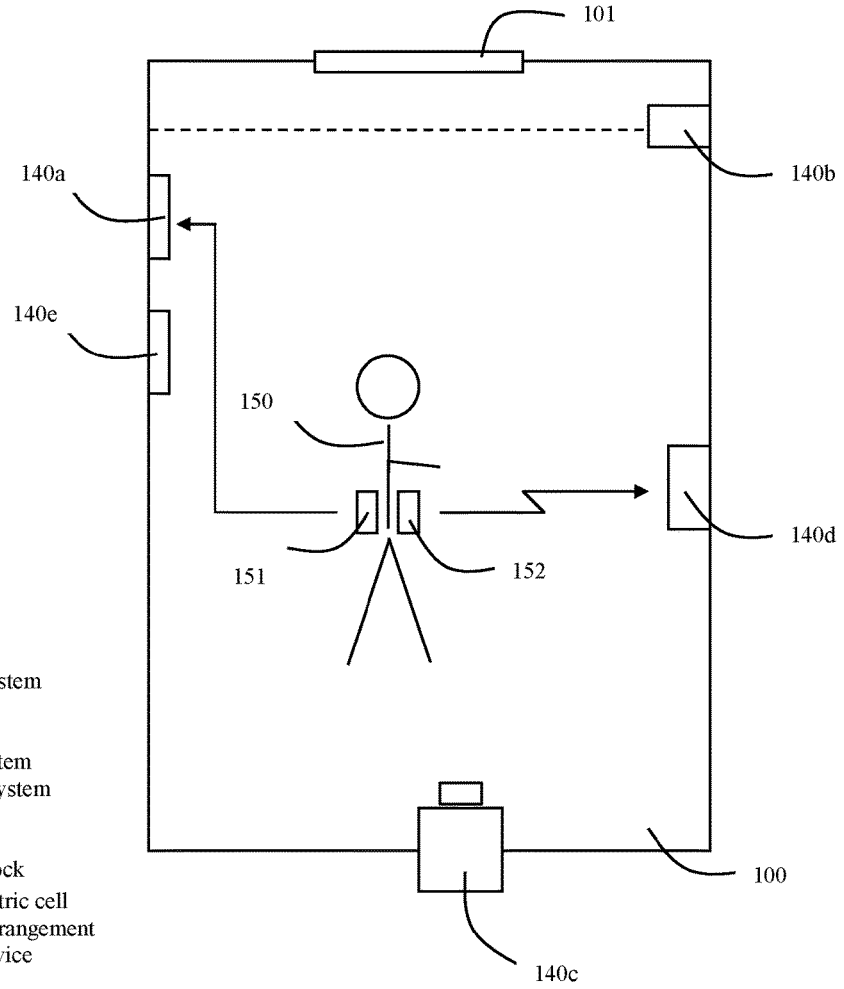
100: apartment
101: door
120: elevator system
121: interface
122: elevator
123: control system
130: back-end system
131: memory
132: interface
140a: storage dock
140b: photoelectric cell
140c: camera arrangement
140d: reader device
140e: switch
150: person
151: keycard
152: terminal device

METHOD AND A SYSTEM FOR AUTOMATIC GENERATION OF ELEVATOR CALLS

CROSS REFERENCE TO RELATED APPLICATIONS

This application is a Continuation of PCT International Application No. PCT/FI2013/051154, filed on Dec. 11, 2013, which claims priority under 35 U.S.C. 119(a) to Patent Application No. 20126321, filed in Finland on Dec. 18, 2012, all of which are hereby expressly incorporated by reference into the present application.

FIELD OF THE INVENTION

The present invention relates to elevator systems. More particularly the present invention relates to a method and to a system for automatically generating calls for an elevator system.

BACKGROUND OF THE INVENTION

In a destination floor elevator system a passenger gives to the elevator system one call, a so-called destination floor call, and not as in conventional elevator systems two calls such that the first call is given in the elevator lobby by designating the desired direction of travel with up/down pushbuttons and the second call in the elevator car by designating with the car pushbuttons the destination floor, i.e. target floor, of the passenger.

A destination call can be given e.g. from a destination operating panel permanently installed in an elevator lobby. When a passenger keys his/her destination floor into the destination operating panel, the destination floor data and also information about from which floor the destination call is given is transmitted to the control system of the elevator system, to the so-called group control. On the basis of given criteria the group control allocates an elevator for the use of the passenger and notifies it, and possibly the location of it, to the passenger e.g. on the display that is in the destination operating panel.

With regard to elevator systems, also known in the art is a call-giving method wherein a passenger is identified e.g. from an RFID identifier and a destination floor is determined for him/her on the basis of the identification data read from the identifier. In this call-giving method a passenger takes an identifier in his/her possession manually to a reader device, which reads the information contained in the identifier, for example an individual ID number, and sends it to the group control of the elevator system. On the basis of the ID the group control determines the destination floor, e.g. the home floor, of the passenger and allocates an elevator for the use of the passenger for traveling to the home floor in question. Also in this case the allocated elevator must be notified to the passenger if there are a number of elevators in the elevator system. Also known in the art are solutions in which the identifier is a so-called remote identifier, the identification data contained in which can be read when the identifier is e.g. in the pocket of the passenger.

In residential apartment buildings and hotels when a person leaves his/her apartment, he/she first goes to the elevator lobby and there gives the elevator call he/she wants and remains to await the elevator. Depending on the transport capacity of the elevator system and the prevailing traffic intensity, he/she may have to wait for quite a long time before the elevator serving him/her arrives at the call-giving floor. In solutions according to prior art the departure of a person from his/her apartment is not therefore used for calling an elevator to be ready on the floor on which the apartment is situated.

Aim of the Invention

The aim of the present invention is to eliminate or at least to alleviate the drawbacks presented above that occur in prior-art solutions. The aim of the invention is also to achieve one or more of the following objectives.

- to improve elevator service,
- to generate elevator calls automatically, and
- to utilize the building automation systems that are in buildings in call-giving.

SUMMARY OF THE INVENTION

The method according to the invention is characterized by what is disclosed in the characterization part of claim 1. The arrangement of the invention is characterized by what is disclosed in the characterizing part of claim 8. Other embodiments of the invention are characterized by what is disclosed in the other claims. Some inventive embodiments are also presented in the drawings in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments can be applied within the framework of the basic inventive concept in conjunction with other embodiments.

The present invention discloses a method for generating automatic elevator calls for an elevator system in a building, in which is at least one apartment, in connection with which is a sensor, the sensor signal to be received from which indicates the departure of a person from an apartment. According to the invention and elevator call is generated to a floor on which the apartment is situated when a person is leaving or has left the apartment on the basis of the aforementioned sensor signal.

The elevator call can be a conventional up/down call or a destination call. On the basis of the destination call the elevator can collect a person from a floor on which the apartment is and take him/her to a predetermined destination floor, e.g. to an entrance lobby or to a parking hall.

The apartment-specific sensors are connected to a back-end system, which generates the aforementioned automatic elevator calls and transmits them to the control system of the elevator system. The back-end system can be a building automation system, in which case the generation of calls on the basis of sensor signals can occur in the building automation system. By utilizing sensors already connected to the building automation, additional sensoring does not need to be installed for elevator calls, in which case the system becomes simpler and maintenance becomes easier.

The present invention also discloses a system for automatically generating elevator calls for an elevator system in a building, which comprises a plurality of apartments, and which elevator system comprises at least one elevator and a control system of the elevator system. According to the invention the system further comprises at least one apartment, which is provided with at least one sensor, the sensor signal produced by which indicates that a person is leaving or has left an apartment, and also a back-end system, which comprises an interface, via which the aforementioned sensor signal is transmitted to the back-end system. The back-end system is arranged to generate an elevator call to a floor on which an apartment is situated on the basis of the aforementioned sensor signal and to transmit the aforementioned elevator call to the control system of the elevator system.

In one embodiment of the invention a storage dock for a keycard of an apartment is used as the sensor. When a person removes the keycard of the apartment from the storage dock, the aforementioned elevator call is generated at the same time. The embodiment can be utilized e.g. in storage docks in hotel rooms, which are used e.g. for controlling on/off the electrics/lighting of the hotel rooms.

In another embodiment the departure of a person is monitored with an optical sensor, e.g. with a photoelectric cell and/or a camera in the hotel room. As a result of the embodiment, the departure of a person from an apartment can be detected automatically without the person taking any special actions for indicating his/her departure.

In another embodiment of the invention a long-range identifier is given to a person, the presence of which long-range identifier in the apartment is monitored with a remote reader. When the remote reader no longer detects (is unable to read) the long-range identifier, it interprets it as the departure of the person from the apartment, in which case an automatic elevator call can be generated. An individual ID number can be recorded in the long-range identifier, on the basis of which ID number a destination call to the floor wanted by the person can be generated. As a result of the embodiment, the departure of a person from an apartment can be reliably detected and information about the individual needs of the person can be connected to an automatic elevator call.

In another embodiment of the invention a special present/absent switch in an apartment is used as a sensor, which switch is connected e.g. to the building automation system and by the aid of which switch a person indicates when he/she enters the apartment and when he/she leaves the apartment. As a result of the embodiment, the building automation system of the building can be utilized, to which system the apartment-specific present/absent switches are connected. The embodiment also enables a person to leave an apartment momentarily without turning the aforementioned switch into the absent position for avoiding unnecessary elevator calls.

In one embodiment of the invention data about the position of the sensor in the building is connected to an elevator call, which data is taken into account in the control of the elevator system. As a result of the embodiment, the elevator system can calculate e.g. how long it will presumably take a person before he/she is in an elevator lobby waiting for a serving elevator and can optimize the operation of the elevator system on the basis of the information.

In one embodiment of the invention the elevator system transmits to a terminal device in the possession of a person information about the elevator that is serving the aforementioned elevator call (the elevator serving the person). As a result of the embodiment, the optimal elevator can be allocated from an elevator group comprising a number of elevators and the person can be guided to the correct elevator.

With the solution according to the invention numerous advantages are achieved compared to prior-art solutions. The solution according to the invention facilitates and speeds up the movement of people in buildings by calling an elevator in advance to the correct floor when a passenger leaves his/her apartment. Traveling is also facilitated because a person does not need to separately give an elevator call. In the solution according to the invention a building automation system and the sensors connected to it can be utilized for generating calls, in which case the system becomes simpler and maintenance becomes easier. Other advantages that can be achieved with the solution according to the invention are mentioned above in connection with the different embodiments.

LIST OF FIGURES

FIG. 1 presents one embodiment of the system according to the present invention.

DETAILED DESCRIPTION OF THE INVENTION

FIG. 1 presents a system according to the invention, with which the departure from an apartment of a person 150 in the apartment 100 is monitored and on the basis of the monitoring automatic elevator calls are generated for the elevator system 120. The apartment 100 is e.g. a hotel room, which a person has reserved for his/her use. The elevator system 120 comprises a control system 123 of the elevator system and at least one elevator 122, which serves the floor on which the hotel room is located. The system further comprises a back-end system 130, to which is connected, via an interface 132, one or more sensors **140*a*-140*e* that are in a hotel room. On the basis of the sensor signal to be received from a sensor 140*a*-140*e*, the back-end system 130 can deduce that a person 150 is leaving and/or has left a hotel room 100. The back-end system in this case automatically generates an elevator call, which it transmits via an interface 121 to the control system 123 of the elevator system. The elevator system sends an elevator according to the aforementioned elevator call to collect the person from the floor on which the hotel room 130 is. The elevator call to be automatically generated can be a conventional up/down call or a destination call. If the elevator call is an up/down call, the elevator arrives at the floor according to the call, opens the doors of the elevator and stays to wait for the arrival of the person 150. When the person arrives in the elevator lobby, he/she goes into the elevator and selects his/her destination floor by pressing the pushbutton in the elevator car for the floor he/she wants. If the elevator system registers destination calls, the back-end system 130 sends to the elevator system a destination call wherein the call-giving floor is the floor on which the hotel room is situated and the destination floor (target floor) is a floor connected to the hotel room 100 in the memory 131 of the back-end system, e.g. a parking floor on which the person 150** keeps his/her car.

FIG. 1 presents a number of different sensor alternatives **140*a*-140*e*, with which the departure of a person from a hotel room 100** can be detected.

**140*a* presents a storage dock on the wall of a hotel room, into which dock a person puts the keycard 151 of the hotel room 100 when he/she enters the hotel room. Correspondingly, when the person is leaving the room 100, he/she takes the keycard from the storage dock. Information about the removal of the keycard is transmitted to the back-end system 130 via the interface 132. Since the storage docks 140*a* are apartment-specific, the back-end system 130** knows from which hotel room a person is leaving and can therefore generate an elevator call to the floor on which the hotel room is.

140*b* presents an optical sensor, which is disposed close to the door 101 of the hotel room and from the signal produced by which the back-end system can deduce the departure of a person from the hotel room and can generate an automatic elevator call in the manner described above. The sensor 140*b* is connected to the back-end system via an interface 132.

140*c* presents a camera arrangement, which monitors the people leaving by the door 101. The camera arrangement 140*c* sends information about a departure to the back-end system 130 via the interface 132 when it detects that a person 150 has left by the door 101. On the basis of the information the back-end system automatically generates an elevator call in the manner described above.

140*d* presents a reader device, e.g. a Bluetooth base station, which monitors the presence in a hotel room 100 of a terminal device 152 or identifier in the possession of a person 150. When the reader device 140*d* detects that the identifier or terminal device has been taken outside its reading range, e.g. out of the hotel room 100, the reader device 140*b* sends information about the departure of the identifier or terminal device to the back-end system 130 via the interface 132, in which case the back-end system generates an automatic elevator call in the manner described above. The identifier is, e.g. a remotely-readable RFID identifier (Radio Frequency Identifier), a terminal device 152 e.g. a mobile phone provided with a Bluetooth connection.

140*e* presents a present/absent switch. When a person arrives in his/her apartment, he/she turns the switch 140*e* to the "present" position, in which case e.g. the building automation system controls the air-conditioning of the apartment on. When the person leaves the apartment, he/she turns the switch to the "absent" position, information about which is transmitted to the back-end system/building automation system, which on the basis of the information generates an elevator call in the manner described above and sets e.g. the air-conditioning to "stand-by" mode.

A sensor (140*a*, 140*b*, 140*c*, 140*d* or 140*e*) is connected either with a fixed or with a wireless data transfer connection to the interface 132 of the back-end system 130 (the data transfer connection is not presented in FIG. 1). The back-end system is able to distinguish the sensor signals of different hotel rooms from each other in such a way that the back-end system has information about from which hotel room a person 150 is leaving or has left. The position data (floor and position coordinates on the floor and/or distance from the elevators) of a hotel room or of a sensor can also be recorded in the memory 131 of the back-end system. The back-end system can connect the position data of a hotel room to an elevator call, on the basis of which the elevator system 120 can estimate when a person 150 will arrive in an elevator lobby to await an elevator and in this way can optimize the operation of the elevator system. From the viewpoint of the operation of the system one sensor (140*a*, 140*b*, 140*c*, 140*d* or 140*e*) is sufficient but a number of apartment-specific sensors can be connected to the back-end system and they can be used simultaneously for improving operational reliability and for avoiding unnecessary elevator calls.

In one embodiment of the invention the elevator system 120 is an elevator group, which comprises a number of elevators 122 and in which the elevator calls can be destination calls. A person 150 has a terminal device 152, e.g. a mobile phone provided with an Internet connection. When the person 150 leaves a hotel room 100, the back-end system 130 automatically generates a destination call for the elevator group 120 in the manner described above. The group control of the elevator group 120 receives the aforementioned call and allocates an elevator from the elevator group for serving the call. The elevator group 120 transmits information about the allocated elevator to the back-end system 130 via the interface 121. The address information, e.g. the IP address, of the terminal device of the passenger is recorded in the memory 131 of the back-end system, on the basis of which address the back-end system sends the identification data of the allocated elevator to the terminal device 152 of the person via the Internet connection. The message to be transmitted to the terminal device is e.g. "Go to elevator B". The elevator system can also send to the back-end system an estimate of how long the allocated elevator will take to arrive at the floor on which the hotel room is. The back-end system sends the aforementioned time estimate onwards to the terminal device of the person, in which case the message e.g. "Go to elevator B, arriving in 40 s" is transmitted to the terminal device from the back-end system.

THE INVENTION IS NOT ONLY LIMITED TO BE APPLIED TO THE EMBODIMENTS DESCRIBED ABOVE, BUT INSTEAD MANY VARIATIONS ARE POSSIBLE WITHIN THE SCOPE OF THE INVENTIVE CONCEPT DEFINED BY THE CLAIMS. THUS, FOR EXAMPLE, THE CONTROL SYSTEM OF THE ELEVATOR SYSTEM CAN COMPRISE ONE OR MORE CONTROL APPARATUSES. THE BACK-END SYSTEM CAN BE AN APPARATUS SEPARATE FROM THE ELEVATOR SYSTEM OR CAN BE INTEGRATED EITHER PARTLY OR WHOLLY INTO THE CONTROL SYSTEM OF THE ELEVATOR.

The invention claimed is:

1. A method for generating automatic elevator calls for an elevator system in a building, in which is at least one apartment, in connection with which is a sensor, the sensor signal to be received from which indicates the departure of at least one person from an apartment, and in which method an automatic elevator call is generated to a floor on which an apartment is situated when a person is leaving or has left the apartment on the basis of the sensor signal, said method comprising the steps of:

connecting the position data, comprising the position coordinates of the sensor on the floor and/or the distance of the sensor from the elevators, of the sensor to the elevator call; and taking the position data into account in the control of the elevator, wherein the sensor is a storage dock for a keycard of an apartment where the elevator call is generated when the at least one person removes the keycard from the storage dock.

2. The method according to claim 1, the method further comprising the step of transmitting information about the elevator serving an elevator call and/or about the arrival time at the call-giving floor to a terminal device in the possession of a person.

3. A system for giving automatic elevator calls to an elevator system in a building, comprising:

at least one elevator and a control system of the elevator system and at least one apartment, which is provided with at least one sensor, the sensor signal produced by which indicates a person is leaving and/or has left an apartment;

a back-end system, which comprises an interface, via which the sensor signal is transmitted to the back-end system; and the back-end system is arranged to generate an elevator call to a floor on which an apartment is situated on the basis of the sensor signal and to transmit the call to the control system of the elevator system via an interface, which elevator call comprises the position data of the apartment or of the sensor, which position data comprises the position coordinates of the sensor on the floor and/or the distance of the sensor from the elevators, wherein the sensor is a storage dock for a keycard of an apartment where the elevator call is generated when the at least one person removes the keycard from the storage dock.

4. The system according to claim 3, wherein the back-end system is arranged to transmit information about the elevator serving an elevator call and/or about its arrival time to a terminal device of a person.

5. The system according to claim 3, wherein the back-end system is a building automation system.

* * * * *